United States Patent [19]

Kline

[11] Patent Number: 4,699,303

[45] Date of Patent: Oct. 13, 1987

[54] GOLF ARTICLE RETAINING DEVICE

[76] Inventor: Michael S. Kline, 166 N. Middaugh St., Somerville, N.J. 08876

[21] Appl. No.: 922,030

[22] Filed: Oct. 22, 1986

[51] Int. Cl.[4] ..... A45F 5/00

[52] U.S. Cl. ..... 224/252; 224/918

[58] Field of Search ..... 224/252, 918, 274, 277; 40/10 R, 11 R; 24/3 R, 3 L

[56] References Cited

U.S. PATENT DOCUMENTS

| | | | |
|---|---|---|---|
| D. 165,253 | 11/1951 | Ward | 224/918 X |
| 251,966 | 1/1882 | Tait . | |
| 1,815,024 | 7/1931 | Foster . | |
| 1,973,819 | 9/1934 | Link . | |
| 2,006,843 | 7/1935 | Russell | 224/277 X |
| 2,566,837 | 9/1951 | Huelsmeyer . | |
| 2,580,985 | 1/1952 | Wooden | 224/36 X |
| 2,593,042 | 4/1952 | Lynskey | 224/918 X |
| 2,604,724 | 7/1952 | Watts . | |
| 2,636,751 | 4/1953 | Carlson . | |
| 2,802,250 | 8/1957 | Klotz | 224/918 X |
| 3,233,802 | 2/1966 | Lupwick | 224/252 X |
| 3,298,579 | 1/1967 | Smith . | |
| 3,830,415 | 8/1974 | Jacobson et al. | 224/918 X |
| 4,358,036 | 11/1982 | Maltais | 224/252 |
| 4,449,310 | 5/1984 | Kline | 224/918 X |
| 4,475,676 | 10/1984 | Smith | 224/918 X |
| 4,556,183 | 12/1985 | Greenberger | 40/11 R X |

FOREIGN PATENT DOCUMENTS

| | | |
|---|---|---|
| 667961 | 8/1963 | Canada . |
| 419588 | 4/1910 | France . |

*Primary Examiner*—Henry K. Artis
*Assistant Examiner*—Robert M. Petrik
*Attorney, Agent, or Firm*—Hoffmann, Dilworth, Barrese & Baron

[57] ABSTRACT

A golf article retaining device adapted to be removably attached to a supporting surface. The device is formed of an elongated strip of spring material in a three leg configuration. The first leg has a free end and is bent at the other end into the second leg overlying the first leg to form a mounting recess adapted to receive the upper end of the supporting surface therebetween. The configuration of the mounting recess substantially conforms to the supporting surface and insertion of the supporting surface into the recess will force the first and second legs apart whereby the tendency to return to the relaxed configuration will resiliently mount the device on the supporting surface. The third leg extends from the end of the second leg opposite to the end connected to the first leg, and overlies the second leg on the side opposite to the side facing the first leg. The second and third legs are resiliently displaceable from one another to permit insertion of a golf score card therebetween. A receptacle is on the device for receiving and retaining a marking implement. The recess between the second and third legs is open to permit use of the device with a variety of different size golf score cards. Appropriate projections are on the first, second and third legs to facilitate engagement and holding of the device to a supporting surface and to retain a golf score card thereon.

18 Claims, 5 Drawing Figures

GOLF ARTICLE RETAINING DEVICE

BACKGROUND OF THE INVENTION

The sport of golf is simultaneously an ancient non-complex game and a modern technical game. Basically, it involves both mental and physical exercise and is directed to the striking of a ball with various differently shaped instruments called clubs in order to advance the ball along a predetermined path and, ultimately, into a hole. The most efficient and effective way that the ball is advanced in the minimum amount of strokes determines the capability of each individual golfer.

In order to carry out the necessary aspects of the game, the golfer generally employs certain tools. For instance, a selection of golf clubs is needed to accomplish the various required shots, along with a supply of golf balls. These items are traditionally stored in a conventional type of golf bag. The bag includes various pockets which may be used to house the balls and is open at the upper end for insertion and removal of the clubs.

The golfer also utilizes a score card to record his individual score and often those of his playing partners. Additionally, the conventional score card often includes other useful information such as the golf course layout, the length of holes, various hazards and local rules that must be observed. Accordingly, the score card becomes a useful tool for the golfer on many occasions.

Furthermore, for marking information on the score card, a marking implement, such as a pencil, is usually employed. Thus, this also becomes an item frequently used by the golfer during a normal round of golf.

Furthermore, the modern golfer employs golf tees on which the ball is placed to initiate play on each individual hole. Again, he must carry tees with him during the round of golf and have them readily available for use.

It is thus apparent that the golfer should have easily accessibility to the golf score card, the marking implement and the golf tees, since he will utilize these various elements many times during an individual round of golf. It can be envisioned how storage of these elements for ready access becomes a problem. They can be stored in the golf bag, on the golfer's person, or occasionally on a golf cart being used to transport the clubs and bag. In any event, it is extremely advantageous to store these elements in the most effective manner for ready access and yet at a location where they are positively retained in position and do not interfere with the golfer's swing or club selection.

Throughout the years, various types of golf article retaining devices have been developed as indicated in my prior U.S. Pat. No. 4,449,310, the contents of which are incorporated herein by reference.

My device as defined in that patent provides an effective unit for carrying out the requirements discussed above. Other types of golfer's devices are apparent in the references discussed and referred to in my prior patent.

While my device as described in that patent produces an effective golfer's aid, there is still room for further improvement to satisfy the golfer's needs. Accordingly, I have developed another improved device which can be described most clearly in the following manner.

SUMMARY OF THE INVENTION

With the above background in mind, it is among the primary objectives of the present invention to provide a golf article retaining device of low cost manufacture and which is useful in releasably holding golf score cards, golf marking pencils, and golf tees. The device is adapted to be easily and positively mounted to a supporting surface on a golf bag or a golfer's belt in position so that easy access is obtainable to the golf score card, marking device and tees being releasably held on the device.

The device is lightweight and is adapted to be mounted in a manner which does not interfere with the golfer's normal swing during a golf round nor interfere with the golfer's removal and insertion of golf clubs with respect to a bag.

A further objective is to provide a device which is formed of a single piece of spring material, for example thermoplastic material such as polypropylene, and includes means to facilitate the mounting and holding of the device on a golf bag or a golfer's belt. Additionally, means is provided to facilitate retention of the golf score card on the device in the desired position.

The device is designed so that, while it resiliently retains the golf score card, marking device and tees in an acceptable manner, it also facilitates release of these items when desired.

In addition, the structure of the device is such that the golf score card, marking device and golf tees are readily accessible to the golfer while the device is attached to the golf bag or the golfer's belt. The golf score card, marking pencil and tees are readily mountable and removable from the device without affecting attachment of the device to the bag or golfer's belt.

A further objective of the invention is to provide a golf article retaining device which is formed of a unitary piece of spring material. The spring material is bent into a configuration which forms first, second and third legs. The second leg overlies the first leg and the third leg overlies the second leg. The configuration of the device between the first and second leg conforms to the shape of the upper end of a golf bag and also to a golfer's belt. To facilitate mounting on the golf bag and belt, at least one projection extends inwardly from the opposing surfaces of the first and second leg to engage the structure on which the device is mounted.

In one particular form of the device, there are two projections, one adjacent the end of the device where the first and second legs are joined and the other adjacent the end of the device where the first and second legs separate to receive the golf bag or golfer's belt therebetween. The projections form a more positive interengagement with the supporting structure. The device is mounted by resiliently separating the first and second legs to permit the insertion of the supporting structure therebetween, and when released, the resilient first and second leg will tend to return to the relaxed position, and with the assistance of the projection, retain the device on the golf bag or golfer's belt.

A further object of the invention is to provide means between the second and third leg to facilitate retention of a golf score card therebetween. It is contemplated that this means could include a depending tab projecting into the space between the first and second legs to engage with the golf score card positioned between the second and third leg. Positioning of the golf score card is accomplished by resiliently separating the second and third legs and inserting the golf score card therebetween. Release of the legs will permit them to return to their relaxed configuration thereby engaging and holding the golf score card in position. The depending tab is in position to cooperate with the second and third legs in retaining the golf score card in the fixed position and preventing its accidental displacement from the device.

The score card can be placed on either side of the depending tab as a matter of choice. In one position, one side of the tab cooperates with the second leg to engage and hold the score card and in the other position, the other side of the tab cooperates with the third leg to engage and hold the score card. Generally, the score card would be folded to fit between the tab and the second leg. In that position, the overlying tab or projection would prevent the score card from being accidentally displaced through the open end of the device between the second and third legs.

A further objective is to provide a device which includes a plurality of projections on the opposing surfaces of the second and third leg to facilitate engagement and retention of the golf score card in the desired position during use of the device either on a golf bag, on a golfer's belt or a similar supporting surface.

It is contemplated that the projections between the first and second legs can be alternated between the adjacent surfaces of the first and second legs. For example, one projection can be positioned on the surface of the second leg extending toward the first leg adjacent to the end in which the structure on which the device is to be mounted is inserted. The other projection can be placed on the surface of the first leg extending toward the second leg adjacent to the end attached to the overlying second leg. The number and arrangement of projections is a matter of choice with the ultimate objective to gain the most effective interengagement with the structure on which the device is to be mounted.

A further objective of the present invention is to provide a golf article retaining device which includes a means for retaining a marking device such as a pencil in a removable manner on the device. In one form, this is accomplished by forming the free end of the third leg into a tubular configuration which will resiliently permit reception and removal of a pencil or other marking implement with respect to either end thereof. Since the third leg is spaced from the structure on which the device is attached, freedom of access is readily present to both the golf marking implement and the golf score card held by the device.

A further objective of the structure is to provide a device with a third leg shorter than the second leg so that a greater portion of the golf score card can be visibly observed while it is retained between the second and third leg of the device and the score card can be more easily grasped and removed from the device.

A still further objective of the invention is to provide a receiving surface on the exposed side of the third leg to permit attachment of indicia thereon such as identifying initials and the like.

A further objective of the present invention is to provide an extending portion which projects outward from the exposed surface of the third leg and away from the second leg so that it is substantially perpendicular to the remainder of the device. The projecting portion includes at least one aperture, with each aperture adapted to removably receive a golf tee therein. In this manner, the golf tees are exposed for ready use while the device is mounted on the golf bag or a golfer's belt. Additionally, the golf tees are positioned so that they do not interfere with the golf score card or marking implement. Neither the golf score card, marking implement or golf tees interfere with the golfer's access to golf clubs within a golf bag nor do they interfere with the golfer's swing.

A further objective is to provide a compact easy to handle device. It is contemplated that the device can be substantially rectangular in configuration with relatively uniform length, substantially constant width and minimum thickness.

In summary, a golf article retaining device is provided which is adapted to be removably attached to a supporting surface. The device includes an elongated strip of spring material. The strip is formed into a configuration including a first leg having a free end and bent at the other end into a second leg overlying the first leg to form a mounting recess adapted to receive the supporting surface therebetween. The configuration of the mounting recess substantially conforms to the supporting surface and insertion of the supporting surface into the recess will force the first and second legs apart whereby the tendency to return to the relaxed configuration will resiliently mount the device on the supporting surface. A third leg extends from the end of the second leg opposite to the end connected to the first leg and overlies the second leg on the side opposite to the side facing the first leg. The second and third leg are resiliently displaceable from one another to permit insertion of a golf score card therebetween and to hold the score card into position. A receptacle is on the device for receiving and retaining a marking implement for the score card therein. The recess between the second and third legs for holding the golf score card is open to permit use of the device with a variety of different size golf score cards. At least one projection extends into the space between the first and second legs at a predetermined location to facilitate engagement of the device with the supporting surface.

It should also be noted that means is in position between the second and third legs to facilitate retention of a golf score card held therebetween. This means can be in the form of a plurality of appropriately positioned projections for engagement with the score card.

A projecting portion of the device includes at least one aperture for a golf tee and is projected outwardly from the device so that the tees are readily accessible for removal from the device.

It is contemplated that the device be compact and thin in cross section with a relatively constant width and the legs lying in close overlying relationship with one another to maintain a minimum thickness.

With the above objectives among other in mind, reference is made to the attached drawings.

DETAILED DESCRIPTION

Article retaining device 20 is preferably formed of a unitary piece of spring material. It may be formed of a spring metal or a thermoplastic such as polypropylene. In the depicted form, the device 20 is formed of polypropylene. Device 20 is designed to hold various articles used in connection with the game of golf. As shown, a marking implement in the form of a pencil 22, a golf score card 24 and two golf tees 26 and 28 can be removably attached to the device.

Figure 4:
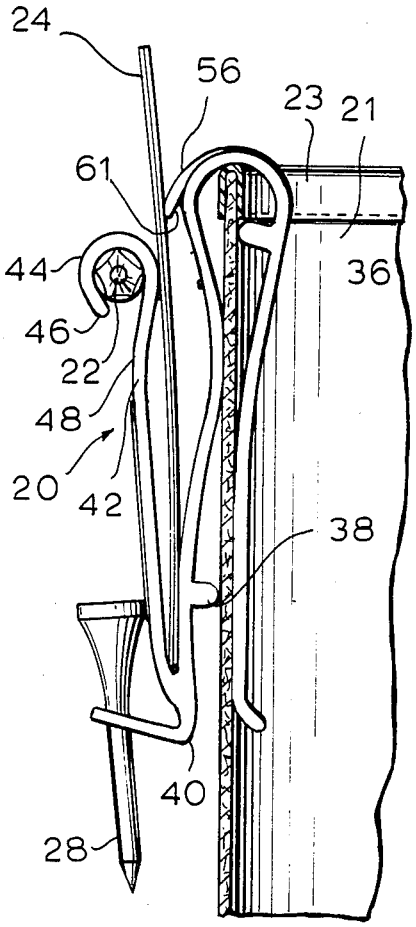
FIG. 4 is a side elevational view thereof with the golf score card, marking pencil and golf tees mounted thereon and the device mounted on the upper end of a golf bag.

The unitary device formed of a single piece of spring material includes a first leg 30 with a free end 33. Free end 33 is curved slightly outwardly to facilitate separation of the legs when a supporting surface is forced therebetween. The opposite end of first leg 30 communicates with a second leg 32 by means of an interconnected bent portion 34. The bent portion 34 is in the form of a loop so that leg 32 overlies leg 30. Legs 32 and 30 are substantially the same in length and are resiliently displacable so as to engage a supporting surface, such as the upper end portion of a golf bag or a golfer's belt. The device is slipped onto the supporting surface by spacing legs 30 and 32 apart, inserting the supporting surface, and thereafter releasing the legs. The resilient legs will tend to return to the relaxed configuration as shown in FIG. 4 and will engage with the inner and outer walls of the golf bag 21 or alternative supporting surface, such as a golfer's belt. The device will attach just as well to any other selected similar and available supporting surface.

The interconnecting bend forming the loop 34 at the closed end between legs 32 and 30 is large enough on its inner diameter to enclose the enlarged rim 23 normally at the upper end of a golf bag. Thus, the legs engaging the golf bag substantially conform to the configuration of the upper end of the bag.

Figure 2:
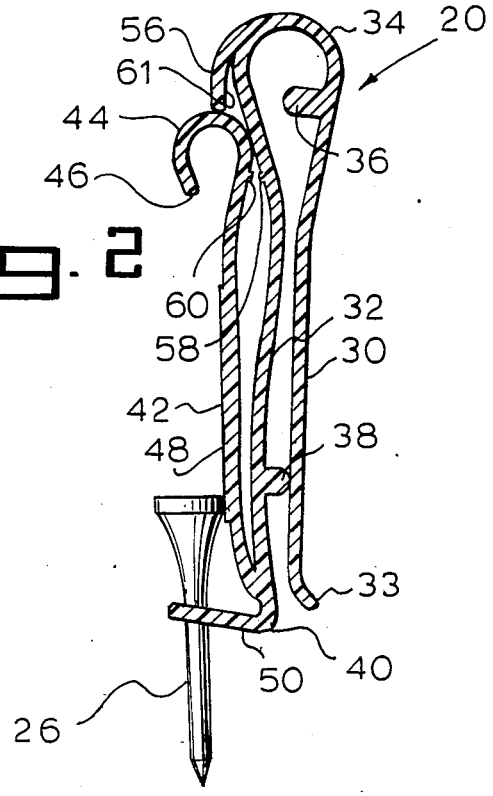
FIG. 2 is a sectional side elevational view thereof taken along the plane of line 2—2 of FIG. 1; and, FIG. 3 is a front elevational view thereof with the golf score card, marking pencil and golf tees mounted thereon and the device mounted on the upper end of a golf bag.

To assist in engagement with the bag and to prevent accidental displacement of the device with respect to the bag, several projections are positioned on the inner surfaces of legs 30 and 32. As shown in FIG. 2, a projection 36 extends inward from the inner surface of leg 30 in a substantially perpendicular direction with respect to the longitudinal axis of the leg. Projection 36 is located adjacent to closed end or loop 34 so that it engages at the upper end of the golf bag 21 usually just below the enlarged rim on the bag.

Similarly, a projection 38 extends from the surface of second leg 32 which faces leg 30. The projection 38 is at a location where it conveniently engages and helps hold the device on the upper end of a golf bag.

Additionally, either projection 38 or projection 36 can be used to engage with a belt worn by a golfer when the device is slipped over the belt so that it extends between resiliently separated legs 30 and 32.

The end 40 of second leg 32 which is distal from loop 34 extends into a third leg 42 which is bent back into overlying relationship with leg 32 on the side opposite to the location of leg 30. Thus, end 40 forms a smaller closed loop between second leg 32 and third leg 42.

Figure 3:
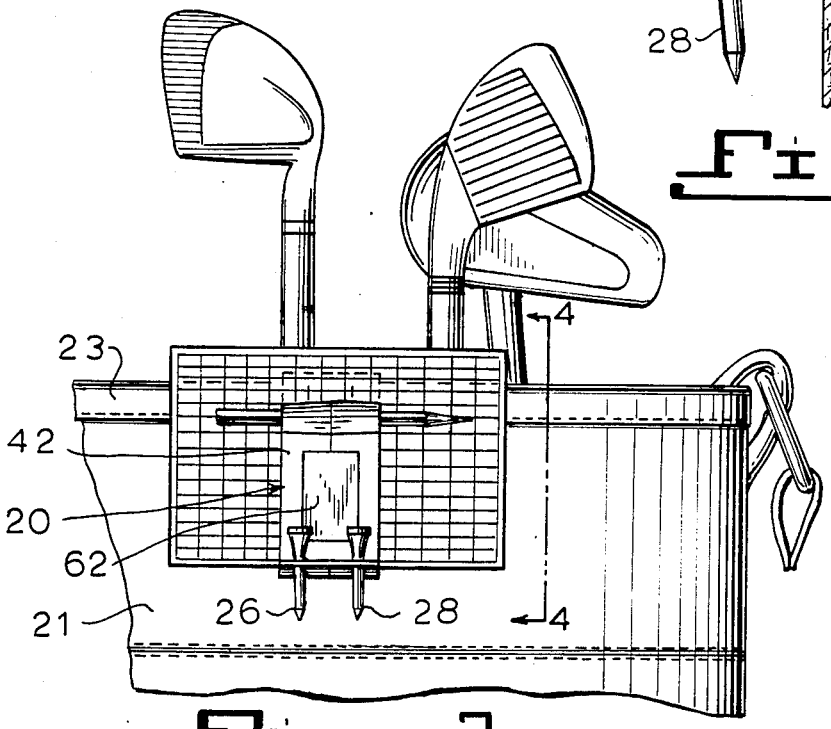

The terminal end 44 of leg 42 is free and is rolled into an arcuate configuration so that the free edge 46 terminates adjacent to the outer surface 48 of leg 42. This rolled end portion 44 forms a tubular receptacle for marking pencil 22, which as shown in FIG. 3, can be inserted therein. The inner diameter of the tubular end 44 is slightly smaller than the outer diameter of the pencil 22 so that, as the pencil is inserted, there will be slight resilient expansion of the tubular end 44 which will engage and hold the pencil in position as the expanded tube 44 tends to return to its relaxed configuration. The gripping force is predetermined due to the elasticity of the device 20 and the size of the tube 44 so that the pencil can be easily inserted and removed as frequently as desired for use.

Adjacent to end 40, in addition to the bend forming leg 42, a second projecting portion or extension 50 is formed. Extension 50 is bent so as to extend substantially perpendicular to the legs 42, 32 and 30. In this manner, the extension 50 forms a shelf. The shelf includes two spaced apertures 52 and 54 into which golf tees 26 and 28 can be respectively extended. The apertures 52 and 54 have a diameter which conforms to approximately the central portion diameter of each golf tee. Accordingly, the tapered golf tees can be inserted into apertures 52 and 54 throughout a portion of their length whereupon the wider diameter portion will engage and hold the tees in position. The relative diameter is adjusted so that the tees cannot pass entirely through the aperture but will extend a sufficient distance to avoid displacement by accidental jarring or tipping of the device such as when the golf bag is shifted from the vertical position or, in the case where the device is on the golfer's belt, during the golfer's normal movements and activities in playing the round of golf including the golf swing.

The interengagement is facilitated also by the resilient nature of the material of device 20 and the frictional engagement with the wooden or plastic golf tees.

The tees are located in this respect well below the top of a golf bag on which the device is mounted and also are distal from the area of the device into which the score card 24 is inserted and removed as depicted in the drawings. Thus, there is little danger of interference between the golf tees, the golf pencil or the score card during use of the device. Each of the various elements are easily accessible for independent insertion and removal.

Figure 1:
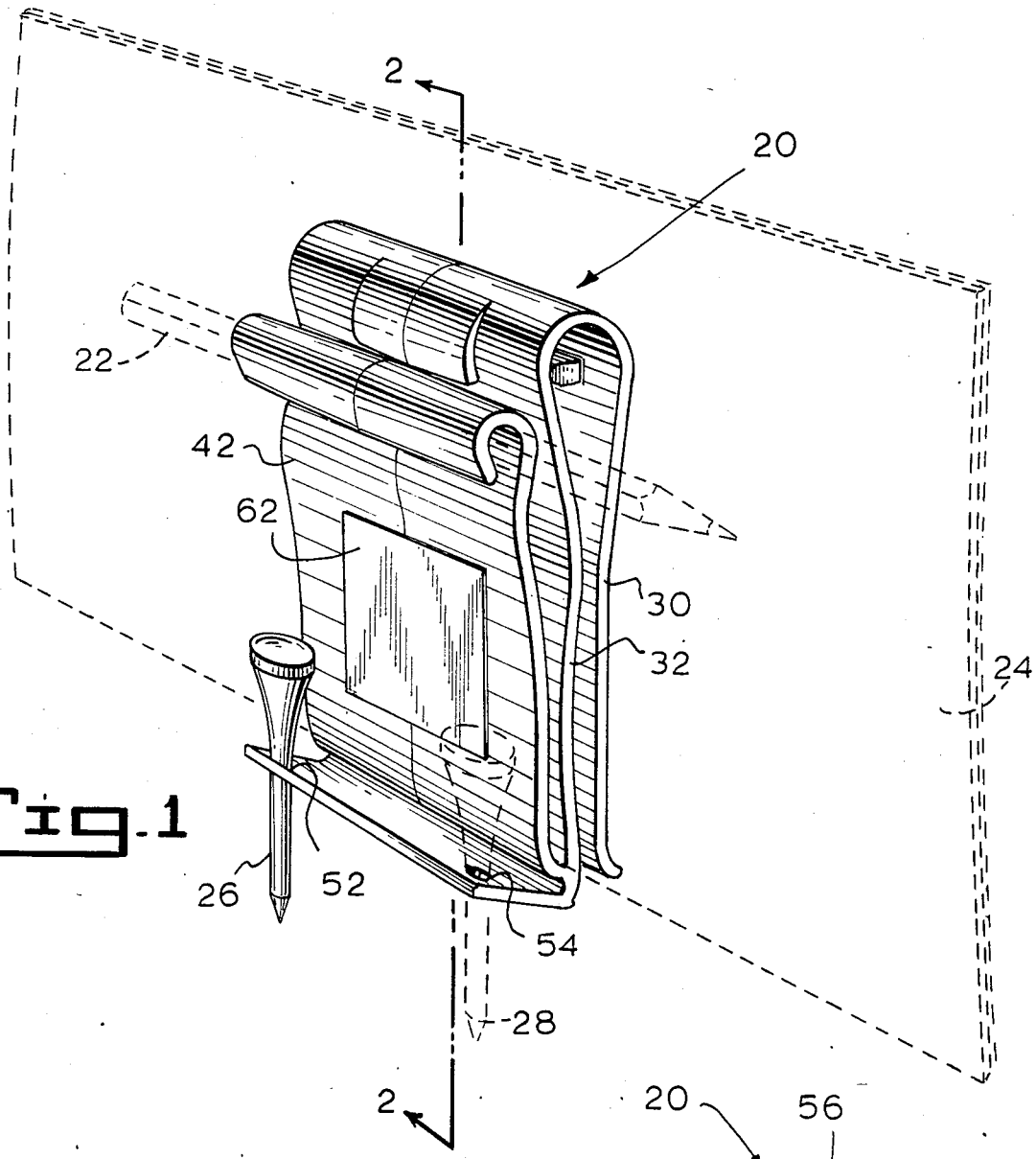
FIG. 1 is a perspective view of the device along with a marking pencil, golf score card and golf tee shown in phantom and golf tee removably mounted thereon.

The score card 24, as shown in FIGS. 1, 3, and 4, is inserted between legs 32 and 42 and these legs are open at the end of insertion and at both side edges. Accordingly, many different size and shape score cards can be easily inserted and removed. This makes the device quite versatile and useful at many locations since various size golf cards are used throughout the world.

Interengagement between legs 32 and 42 and the score card 24 is accomplished in a similar manner as the supporting surface and legs 30 and 32. Legs 42 and 32 are resiliently displaced when the score card is inserted therebetween and the resilient nature of the legs will tend to return them to their initial relaxed configuration so that the score card is held in position. To assist in maintaining the score card in this fixed position, and to avoid accidental displacement or tipping of the card, further engaging surfaces are located on the facing surfaces of legs 32 and 48. As shown, it has been found effective to make leg 42 somewhat shorter than leg 32. This permits a greater portion of the score card to be observed while it is held in the device for reading information or placing information thereon. Additionally, it is easier to remove the score card since a greater portion is exposed for grasping when it is desired to consult information or mark indicia thereon.

To facilitate retention of the score card in the fixed position, a depending projection 56 extends from the upper end of the inner surface of leg 32 which faces leg 42. The projection 56 is arcuate in shape so that it depends outward, and then inward, as it extends downward, thus extending to a point adjacent to the rolled free end 44 of leg 42. This arcuate depending projection 56 assists in the engagement with score card 24 as shown. Furthermore, since it is arcuate in configuration and has a curved outer surface it provides minimum interference with insertion and removal of the card. Frictional and interfering surfaces are minimal.

Figure 1A:
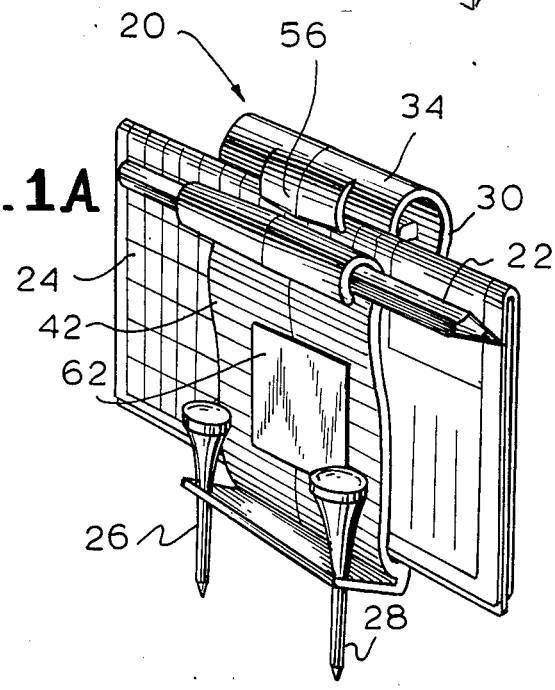
FIG. 1A is a perspective view thereof along with a marking pencil, golf tees and a golf score card mounted thereon with the golf score card in an alternative location.

The positioning and shape of projection 56 adds to the versatility of the device 20. As shown in FIG. 1A, there is an alternative mounting position for score card 24. If the score card is small in size or folded, it can be slid beneath projection 56 so that the projection overlies the score card and the score card is captured between the undersurface 61 of projection 56 and the adjacent surface of the second leg 32. This option provides, if desired, a more positive holding action for the score card. It is restricted from displacement through the open end of the device and from rotational movement out of the open sides of the device by the presence of overlying projection 56. Removal of the score card 24 is achieved by sliding the score card out through either side edge or by applying sufficient force to bend the score card and free it from engagement with the undersurface of projection 56, at which time it can be removed in the same manner as the score card in FIGS. 1, 3 and 4.

Also assisting in retention of score card 24 between legs 32 and 30 are a pair of small or opposing mating projections 58 and 60 on the opposing adjacent surfaces of legs 32 and 42. These small projections again provide a more positive interengagement with the score card when it is placed between the resiliently parted legs 42 and 32.

The number of projecting surfaces between legs 30 and 32 and 32 and 42 are a matter of choice. The positioning is determined by the desired points of maximum engagement with the score card and supporting structure on which the device is mounted. As shown, a preferred form includes the projections 36 and 38 between legs 30 and 32 and the depending projection 56 and opposing smaller projections 58 and 60 between legs 32 and 42.

A further element of structure on device 20 which is useful to the golfer is surface portion 62 on the exposed surface of third leg 42. This portion is formed as a smooth continuous surface adapted to easily receive and retain in adhered position thereon indicia such as golfer's initials or other desired information. As shown, a rectangular configuration is imparted to this prepared surface portion 62, however, the shape is a matter of choice. Since this surface portion is always observable, it is at a location which is particularly desirable for identifying indicia or information of interest.

In use, the device 20 can be easily, attached to the supporting surface by merely forcing legs 30 and 32 away from one another and slipping the device onto the upper end of the golf bag, golfer's belt or the like. The resilient nature of legs 30 and 32 tending to return to the relaxed configuration when released will grip the supporting surface and retain the device in position. The gripping action is assisted by the presence of projections 36 and 38. Ease of insertion is assisted by the presence of curved free end 33 and of leg 30.

Of course, the device can be easily removed from the supporting surface as well. It merely is grasped and, with a minimum amount of force, slid off the surface which passes from between legs 30 and 32 through the open end.

The score card 24 can be easily slipped between legs 32 and 42 by resiliently separating the legs and, when they are released, their tendency to return to the relaxed configuration will hold the score card in position. Once again, projection 56 and projections 58 and 60 assist in gripping and holding the score card in position. Alternatively, the score card can be positioned on either side of projection 56, as shown respectively in FIGS. 1 and 1A.

The tees are inserted into apertures 52 and 54 until they reach approximately the mid point of their tapered length at which time they will be held in position and can be easily withdrawn one at a time when needed.

The marking pencil 22 is insertable in tubular end 44 and the slightly expanded resilient tubular end will grip the pencil and retain it in position until needed.

The number of apertures for tees in the projection 50 is a matter of choice as is the size of the indicia bearing smooth surface 62 on leg 42.

With the exposed surface of leg 30 being interiorally of the golf bag or within the golfer's clothing, the remainder of the structure is exposed for observation and ready access to the elements contained therein. Accordingly, ease of removal and placement of the pencil 22, the score card 24 and the tees 26 and 28 is present. Additionally, the surface 62 is readily observable.

Thus, the several aforenoted objects and advantages are most effectively attained. Although several somewhat preferred embodiments have been disclosed and described in detail herein, it should be understood that this invention is in no sense limited thereby and its scope as to be determined by that of the appended claims.

I claim:

1. A golf article retaining device adapted to be removably attached to a supporting surface comprising;

an elongated strip of spring material;

the strip being formed into a configuration including a first leg having a free end and bent at the other end into a second leg overlying the first leg to form a mounting recess adapted to receive the upper end of a supporting surface therebetween;

the configuration of the mounting recess substantially conforming to the supporting surface and insertion of the supporting surface into the recess will force the first and second legs apart whereby the tendency to return to the relaxed configuration will resiliently mount the device on the supporting surface;

a third leg extending from the second leg opposite to the end connected to the first leg and overlying the second leg on the side opposite to the side facing the first leg;

the second and third legs being resiliently displaceable from one another to permit insertion of a golf score card therebetween and to hold the score card in position;

a receptacle on the device for receiving and retaining a marking implement for the score card therein;

the recess between the second and third legs for holding the golf score card being open to permit use of the device with a variety of different size golf score cards;

means positioned in the space between the first and second legs at a predetermined location to facilitate engagement of the device with the supporting surface;

the means positioned in the space between the first and second legs to facilitate engagement with the supporting surface includes at least one projection extending from said first leg toward said second leg adjacent the end connected to the second leg and at least one projection extending from said second leg toward said first leg adjacent the end of the second leg connected to the third leg, the projections on the first and second leg being adjacent opposite ends of said device and the projections on the first leg providing opposing engagement forces to the projections ont he second leg so that when the device is mounted on a supporting surface, the projections on the first leg will engage one side of the supporting surface and the projections on the second leg will engage the other side of said supporting surface at spaced points thereon to provide opposing forces for facilitating retention of the device thereon in cooperation with the other surfaces on said device engaging the supporting surface to maintain the device in fixed position on said supporting surface when the first and second legs are resiliently coupled thereto; and means positioned between the second and third legs for facilitating retention of the golf score card held between the second and third legs and said means being in the form of a depending projection extending from a point adjacent the bend between the first and seocnd legs to a point adjacent to the end of the third leg distal from the end connected to the second leg so that when the golf socre card is positioned between the second and third legs, it will engage the depending projection therebetween thereby facilitating retention of the golf score card with respect to the device.

2. The invention in accordance with claim 1 wherein the exposed surface of the third leg which is opposite to the surface facing the second leg includes an identification receiving portion adapted to facilitate the mounting of indicia thereon.

3. The invention in accordance with claim 1 wherein the receptacle for holding a marking implement is formed by a curved end of the third leg opposite to the end connected to the second leg, the end of the third leg being bent into a hollow tubular configuration to receive and retain the marking implement for a golf score card therein.

4. The invention in accordance with claim 1 wherein the third leg is shorter than the second leg to facilitate access to the golf score card held in the device for marking of indicia thereon and to space the marking implement from the supporting surface on which the device is mounted.

5. The invention in accordance with claim 1 wherein the device is substantially rectangular in configuration and is of substantially uniform width throughout its length.

6. The invention in accordance with claim 1 wherein the depending projection has a free end positioned between the second and third legs so that the golf score card can alternatively be placed between the projection and the second leg or the projection and the third leg and be retained in position.

7. The invention in accordance with claim 1 wherein at least one protuberance is on the engaging surfaces of the second and third leg to facilitate interengagement therebetween and retention of the golf score card therebetween, the protuberances cooperating with the depending projection and the second and third legs to facilitate retaining of the golf score card in position.

8. The invention in accordance with claim 1 wherein the device is formed of thermoplastic material.

9. The invention in accordance with claim 1 wherein an extension projects from the device and contains at least one aperture for the removable insertion of a golf tee therein thereby enabling the device to be used for retaining golf tees in position for removal and use when needed.

10. The invention in accordance with claim 9 wherein the extension projects from the bend interconnecting the second and third legs and outwardly substantially perpendicular to the planes of the second and third legs into a position in alignment with the exposed surface of the third leg so that when the device is attached to a supporting surface the extension will be in position for easy access to at least one golf tee held therein.

11. The invention in accordance with claim 1 wherein the supporting surface is formed by a golf bag designed to hold golf clubs.

12. A golf article retaining device adapted to be removably attached to a supporting surface comprising:

an elongated strip of spring material;

the strip being formed into a configuration including a first leg having a free end and bent at the other end into a second leg overlying the first leg to form a mounting recess adapted to receive the upper end of a supporting surface therebetween;

the configuration of the mounting recess substantially conforming to the supporting surface and insertion of the supporting usrface into the recess will force the first and second legs apart whereby the tendency to return to the relaxed configuration will resiliently mount the device on the supporting surface;

a third leg extending from the end of the second leg opposite to the end connected to the first leg and overlying the second leg on the side opposite to the side facing the first leg;

the second and third legs being resiliently displaceable from one another to permit insertion of a golf score card therebetween and to hold the score card in position;

a receptacle on the device for receiving and retaining a marking implement for the score card;

13. The invention in accordance with claim 12 where the means for facilitating retention of the golf score card held between the second and third legs is in the form of a depending projection extending from a point adjacent the bend between the first and second legs to a point adjacent to the end of the third leg distal from the end connected to the second leg so that when the golf score card is positioned between the second and third legs, it will engage the depending projection therebetween thereby facilitating retention of the golf score card with respect to the device.

14. The invention in accordance with claim 13 wherein the depending projection has a free end positioned between the second and third legs so that the golf score card can alternatively be placed between the projection and the second leg or the projection and third leg and be retained in position.

15. The invention in accordance with claim 13 wherein at least one protuberance is on the engaging surfaces of the second and third leg to facilitate interengagement therebetween and retention of the golf score card therebetween, the protuberances cooperating with the depending projection and the second and third legs to facilitate retaining of the golf score card in position.

16. The invention in accordance with claim 12 wherein an extension projects from the device and contains at least one aperture for the removable insertion of a golf tee therein thereby enabling the device to be used for retaining golf tees in position for removal and use when needed.

17. The invention in accordance with claim 16 wherein the extension projects from the bend interconnecting the second and third legs and outwardly substantially perpendicular to the planes of the second and third legs into a position in alignment with the exposed surface of the third leg so that when the device is attached to a supporting surface the extension will be in position for easy access to at least one golf tee held therein.

18. The invention in accordance with claim 12 wherein the supporting surface is formed by a golf bag designed to hold golf clubs.

* * * * *